United States Patent [19]

Rheaume

[11] 3,943,980

[45] Mar. 16, 1976

[54] MULTI-PLY WOVEN ARTICLE HAVING DOUBLE RIBS

[75] Inventor: Walter A. Rheaume, Fullerton, Calif.

[73] Assignee: Hitco, Irvine, Calif.

[22] Filed: Oct. 4, 1974

[21] Appl. No.: 512,290

Related U.S. Application Data

[63] Continuation of Ser. No. 290,546, Sept. 20, 1972, abandoned.

[52] U.S. Cl. ..... 139/384 R; 139/410; 428/178; 428/225

[51] Int. Cl.[2] ..... D03D 3/00; D03D 11/00

[58] Field of Search..... 139/384 R, 410; 161/72, 161/49, 88, 98, 68, 69, 127; 181/33 HB; 428/188, 178, 225

[56] References Cited

UNITED STATES PATENTS

| | | | |
|---|---|---|---|
| 3,090,406 | 5/1963 | Koppelman et al. | 139/410 |
| 3,481,427 | 12/1969 | Dobbs et al. | 181/50 |
| 3,538,957 | 11/1970 | Rheaume | 139/410 |
| 3,575,776 | 4/1971 | MacIntyre | 139/410 |

*Primary Examiner*—George F. Lesmes
*Assistant Examiner*—James J. Bell
*Attorney, Agent, or Firm*—Fraser and Bogucki

[57] ABSTRACT

A multi-ply woven fabric article as disclosed has opposite woven face plies and a pair of woven rib plies which extend alternately between and are interwoven with the face plies. The rib plies which are interwoven with each other at the regions of interweaving with the face plies form parallel pairs of ribs extending between the opposite face plies in zig zag fashion and defining generally planar pockets therebetween. The pockets so formed are capable of readily receiving generally planar stiffening elements to provide a woven fabric article of substantial compressive strength.

4 Claims, 3 Drawing Figures

FIG. -1
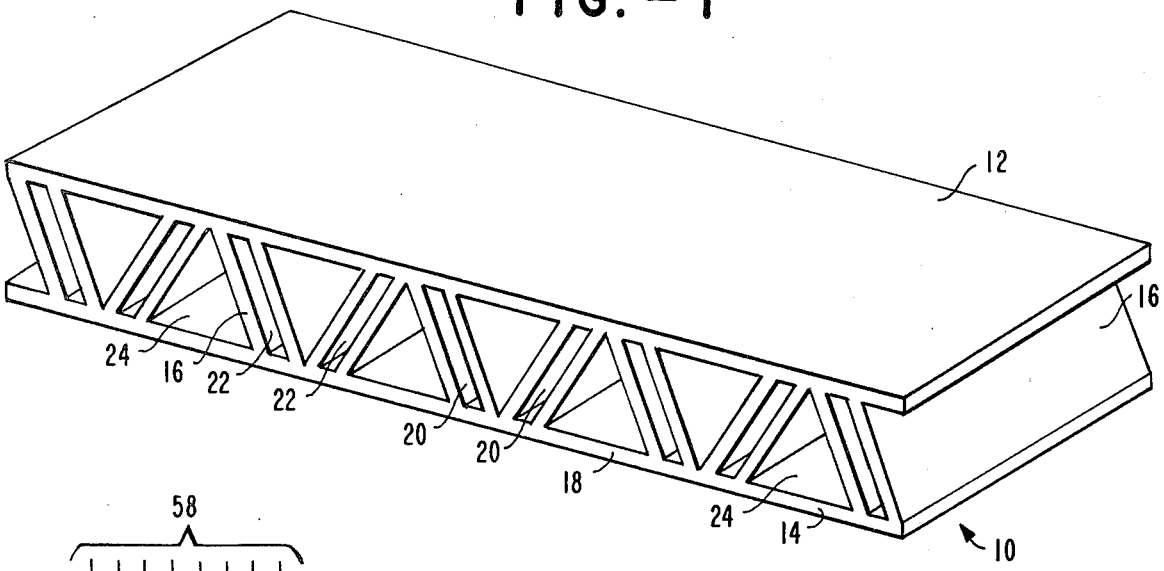
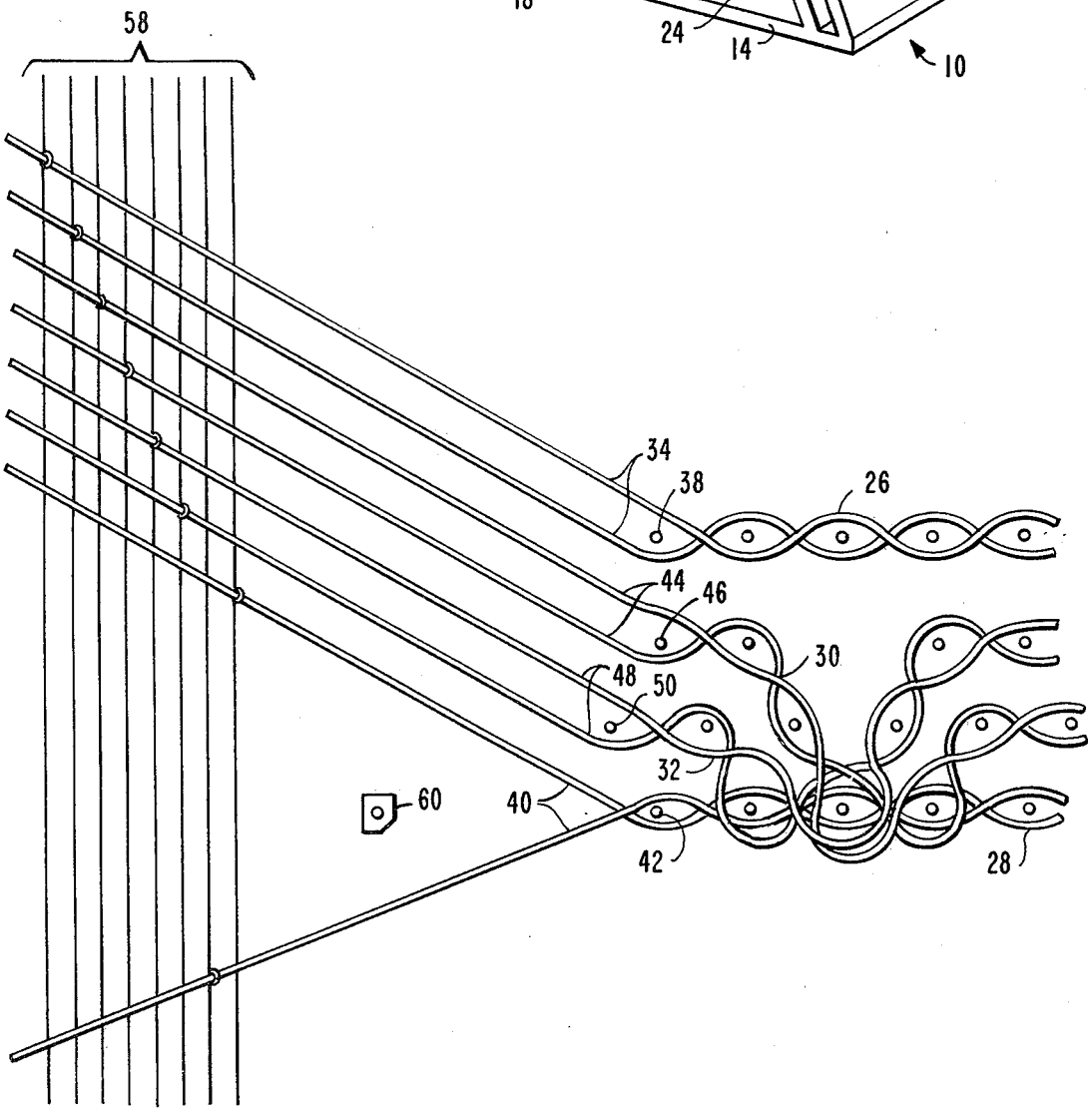
FIG. -3

MULTI-PLY WOVEN ARTICLE HAVING DOUBLE RIBS

This is a continuation of application Ser. No. 290,546, filed Sept. 20, 1972, now abandoned.

BACKGROUND OF THE INVENTION

1. Field of the Invention

The present invention relates to woven fabrics, and more particularly to multi-ply woven fabrics of the type which may be provided with internal stiffening elements and rigidified such as by resin impregnation to provide a strong and yet lightweight structural panel.

2. History of the Prior Art

Woven multi-ply, three-dimensional fabrics of the type having opposite woven face plies and a plurality of intermediate woven ribs which extend between and are interwoven with the face plies are well known in the art. Such fabrics have proven capable of being reinforced such as by the insertion of stiffening elements into the open spaces therein and rigidified such as by resin impregnation to provide panels which are strong, yet lightweight and inexpensive. The uses for such panels are virtually unlimited, and presently include walls, roofs, floors, airframe components, and insulation.

Examples of multi-ply, three-dimensional woven fabric articles and the methods of making the same are provided by U.S. Pat. No. 3,090,406 of Koppelman et al, issued May 21, 1963. As described in Koppelman et al a multi-ply, three-dimensional fabric may be woven on a conventional shuttle loom so as to have opposite face plies and an intermediate rib ply which zig zags between and is interwoven with the opposite face plies.

The woven fabric disclosed in the Koppelman et al patent has proven to be highly useful in the manufacture of panels for a wide variety of applications. Upon weaving of such fabrics mandrels are typically inserted within the triangular-shaped spaces therein during resin impregnation and curing so as to rigidify the structure. Frequently the triangular-shaped spaces are filled with foam elements prefabricated to the size of the triangular-shaped openings and inserted thereinto using mandrels. Where foam inserts are used they may be placed in the fabric openings prior to resin impregnation so as to hold the fabric erect and rigid during impregnation. The resulting rigidized article comprises a panel which is lightweight, strong and yet relatively inexpensive. The foam inserts, where used, add considerable strength to the article as well as enhancing the insulating properties thereof.

However fabrics of the type described suffer from a number of limitations which may render them impractical or unsuitable for certain applications. One of the most serious limitations of such fabrics is their rather low compressive strength. While the foam inserts, where used, add somewhat to the resistance of the article to compressive forces, the compressive strength as well as other structural features of the article may prove inadequate for many applications. For example panels measuring approximately ¾ inch in thickness and made of fiberglass yarns which have been resin impregnated and supported by foam fillers are typically capable of withstanding a maximum of 150 to 200 lbs. per square inch. Such articles furthermore lack the versatility which may be desired for certain applications. For example it may be highly desirable to be able to insert stiffening elements into the woven fabric so as to greatly rigidify the article between the opposite face plies. At the same time, however, it may be essential that the filler elements be thin so as to be light in weight or to conserve on materials, thereby making it impractical to fill the entire spaces within the woven fabric.

BRIEF SUMMARY OF THE INVENTION

The present invention provides a multi-ply, threedimensional woven fabric article in which the opposite woven face plies of the fabric have a pair of woven rib plies extending therebetween and interwoven with the opposite face plies. The rib plies extend between the opposite face plies in zig zag fashion such that adjacent portions of the two different rib plies which are parallel to each other form thin, generally planar pockets. The pockets may be readily filled with stiffening elements of considerable thinness or compact size so as to greatly increase the compressive strength of the resulting article without significant increase in the weight or expense of the article.

Fabrics in accordance with the invention are readily woven on a conventional shuttle loom of the type having four separate shuttles. Two of the shuttles are used to respectively form the opposite face plies while the remaining two shuttles are used to form respective ones of the rib plies. The various shuttles traverse eight different warp yarns which are individually held in raised or lowered positions by programmed harnesses so as to pull a single fill yarn back and forth therethrough and thereby weave the fabric. The interweaving of the rib plies with the opposite face plies is such that the rib and face plies share common fill yarns through several picks of weaving. In addition the weaving may be programmed such that the areas of interweaving of the two different rib plies with each face ply overlap with the two different rib plies sharing at least one common fill yarn.

BRIEF DESCRIPTION OF THE DRAWINGS

The foregoing and other objects, features and advantages of the invention will be apparent from the following more particular description of a preferred embodiment of the invention, as illustrated in the accompanying drawings, in which:

FIG. 1 is a perspective view of an article made from a multi-ply, three-dimensional woven fabric in accordance with the invention;

FIG. 3 is a diagrammatic view showing the fabric of FIG. 2 being woven in the flat on a shuttle loom.

DETAILED DESCRIPTION

Figure 2:
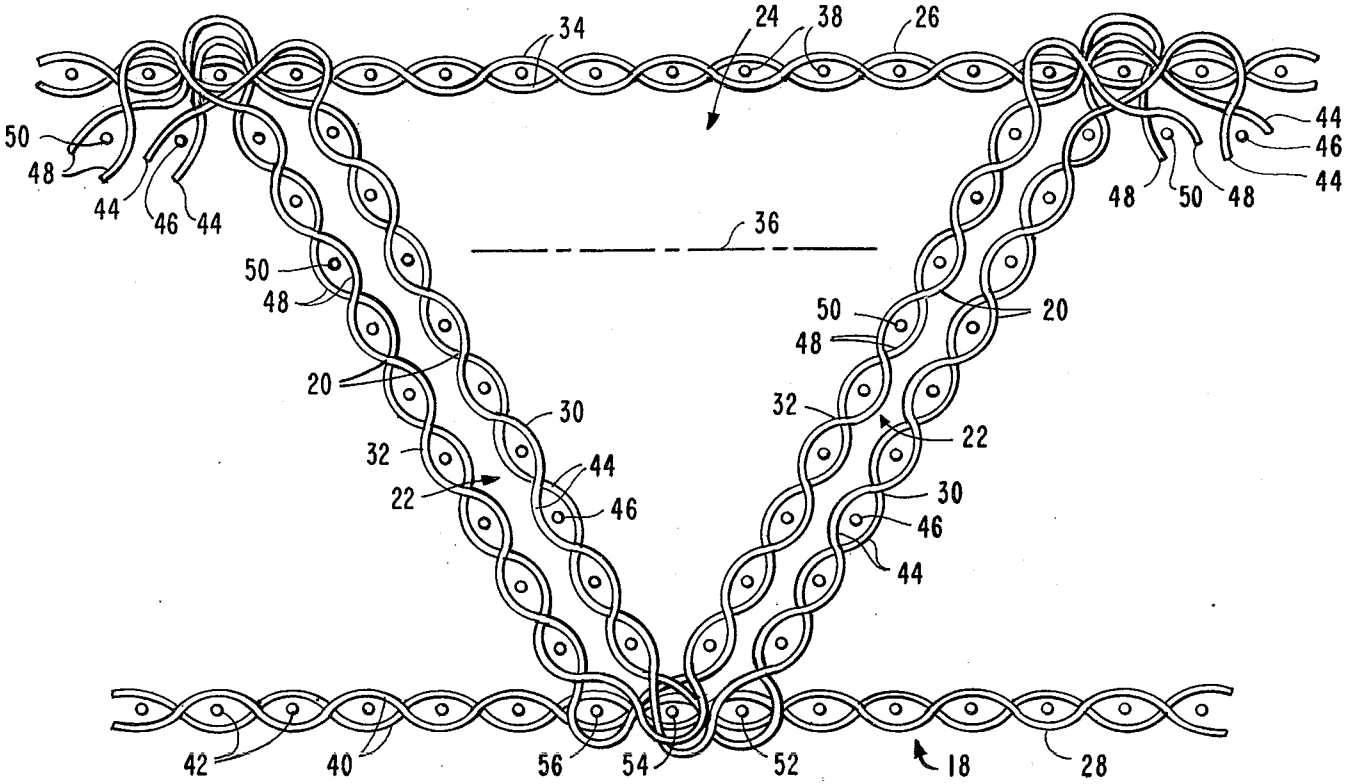
FIG. 2 is a fragmentary sectional view of the woven fabric in the article of FIG. 1 showing weaving details thereof.

FIG. 1 depicts a three-dimensional panel or article 10 in accordance with the invention. The article 10 includes opposite top and bottom faces 12 and 14 respectively which are relatively thin and generally planar and which are disposed in parallel, spaced apart relation to one another. The article 10 also includes a plurality of ribs 16 extending between and interconnecting the opposite faces 12 and 14.

The article 10 is comprised of a multi-ply woven fabric 18 which is integrally woven as described in connection with FIGS. 2 and 3 and which has been resin impregnated to form the rigid article 10 of FIG. 1. In accordance with the invention the portions of the woven fabric 18 forming the ribs 16 are interwoven with the portions of the fabric 18 forming the faces 12 and 14 so as to provide parallel pairs 20 of the ribs 16 which extend in zig zag fashion between the faces 12 and 14 and form a plurality of generally planar pockets 22. The ribs 16 also form open spaces 24 of generally triangular cross-section with the various faces 12 and 14.

As described in detail in connection with FIG. 2 the woven fabric 18 within the article 10 is comprised of warp yarns interwoven with fill yarns. The warp yarns of the faces 12 and 14 extend in the direction of elongation of the faces along the length of the article 10 with the fill yarns extending transversely thereto. The ribs 16 are similarly comprised of warp yarns extending in zig zag fashion along the longitudinal length of the article 10 and interwoven fill yarns extending transversely to the direction of elongation of the article 10. The various warp and fill yarns of the faces 12 and 14 form face plies of the woven fabric 18. The various ribs 16 comprise two different rib plies of the woven fabric 18 which are interwoven alternately and at spaced intervals with the face plies such that the various areas of interweaving of the different rib plies with the face plies overlap.

As described in a copending application, Serial No. 290,541, filed Sept. 20, 1972, now abandoned Donald M. Hatch, Multi-Ply Woven Article Having Stiffening Elements Between Double Plies, which application is assigned to the same assignee as the present application, the various planar pockets 22 formed by the parallel pairs 20 of the ribs 16 are ideally configured so as to receive relatively thin, generally planar stiffening elements. Because of the zig zag configuration of the pockets 22 and the triangular-shaped spaces 24 therebetween, the various stiffening elements can be made thin and light in weight while at the same time providing the article 10 with substantial strength and particularly high resistance to compression. In one article of approximately ¾ inch thickness actually fabricated and tested in accordance with the invention and utilizing stiffening elements of approximately 1/16 inch thickness within the pockets 22 as described in said copending application Ser. No. 290,542, the resistance to compression is on the order of 3,000 lbs. per square inch. This compares with a maximum tolerable compression load on the order of 150 to 200 lbs. per square inch in woven fabric articles of similar dimensions but without the benefit of the stiffening elements and having the single rib configuration of the previously referred to U.S. Pat. No. 3,090,406 of Koppelman et al.

FIG. 2 depicts the details of the woven fabric 18 comprising the article 10 of FIG. 1. As seen in FIG. 2 the top face 12 is primarily comprised of a generally planar, woven, top face ply 26. The bottom face 14 of the article 10 is comprised primarily of a generally planar, woven, bottom face ply 28. The various ribs 16 of the article 10 are comprised primarily of portions of first and second rib plies 30 and 32 respectively.

The top face ply 26 includes a plurality of warp yarns 34 which extend generally in the direction of an axis of elongation 36 for the woven fabric 18. The warp yarns 36 are interwoven with a plurality of fill yarns 38 extending generally transversely to the axis of elongation 36.

In like fashion the bottom face ply 28 is comprised of warp yarns 40 extending generally in the direction of the axis of elongation 36 and interwoven with a plurality of fill yarns 42 which are generally transverse to the axis 36.

The first rib ply 30 includes a plurality of warp yarns 44 extending along the lengths of the ribs formed thereby in the general direction of the axis of elongation 36 and interwoven with a plurality of fill yarns 46. Similarly the second rib ply 32 includes warp yarns 48 extending along the length of the woven fabric 18 and interwoven with fill yarns 50.

As seen in FIG. 2 the first and second rib plies 30 and 32 are interwoven with the face plies 26 and 28 at selected areas along the lengths of the face plies 26 and 28. The nature of the interweaving is such that the rib plies 30 and 32 share common fill yarns with the face plies 26 and 28 through several picks of the length of the woven fabric 18. In addition the areas of interweaving of the two different rib plies 30 and 32 at each of the face plies 26 and 28 overlap such that the rib plies 30 and 32 share at least one common fill yarn with each other as well as with the respective face ply at the areas of interweaving therewith. This provides the fabric 18 with substantial strength as well as other desirable properties.

In the particular example of FIG. 2 the rib plies 30 and 32 share three common fill yarns 52, 54 and 56 with the bottom face ply 28. The first rib ply 30 is interwoven with and thereby shares the fill yarns 52 and 54 with the bottom face ply 28. The second rib ply 32 shares the fill yarns 54 and 56 with the bottom face ply 28. Thus the fill yarn 52 is common to the first rib ply 30 and the bottom face ply 28. The fill yarn 56 is common to the second rib ply 32 and the bottom face ply 28. The intermediate fill yarn 54 is common to both rib plies 30 and 32 as well as to the bottom face ply 28 and defines the region of overlap of the two different areas of interweaving of the rib plies 30 and 32 with the bottom face ply 28.

In the particular example of FIG. 2 each area of interweaving of the rib plies 30 and 32 with one of the face plies 26 and 28 includes three common fill yarns, two of which are common to one of the rib plies as well as to the face ply and one of which is common to both of the rib plies and the face ply.

It will be noted from FIG. 2 that the rib plies 30 and 32 have approximately the same density or picks per inch of length thereof as do the face plies 26 and 28. Since the rib plies 30 and 32 zig zag back and forth between the opposite face plies 26 and 28 they have a greater overall length than do the face plies 26 and 28 for a given length of the woven fabric 18. By the same token each of the rib plies 30 and 32 has a greater number of picks of fill yarn per unit of length thereof along the axis of elongation 36 than do either of the face plies 26 and 28. Accordingly and as seen in FIG. 2 the portion of each of the rib plies 30 and 32 which is disposed between adjacent areas of interweaving with one of the face plies such as the top face ply 26 has a greater number of picks than the corresponding portion of the face ply 26 which is disposed between the same two areas of interweaving.

One technique for weaving the woven fabric 18 in the flat on a conventional shuttle loom is diagrammatically illustrated in FIG. 3. The loom used may be a conventional box loom such as the type manufactured by Crompton Knowles Weavers, Inc. under the name "Cottom King", and is assumed to have four separate shuttles. The loom includes eight separate heddle harnesses 48, each of which controls a different bank of the warp yarns 34, 40, 44 and 48 in conventional fashion. A conventional pattern chain and associated control mechanism control the sequence of shuttles and movement of the harnesses 58 in timed sequence with the shuttle and reed movement of the loom in conventional fashion. Thus, in the example of FIG. 3 the bottom face ply 28 is being woven by the insertion of a fill yarn 42 between the opposite sets of the warp yarns 40 by the passage of a shuttle 60 therethrough. Although the loom is assumed to be equipped with four separate shuttles only the one shuttle 60 is shown in FIG. 3 for convenience of illustration. The particular shuttle 60 is used to insert the fill yarn between the opposite sets of the warp yarns 40 and there by weave the bottom face ply 28. A second shuttle on the loom is used to insert the fill yarns 38 between the opposite sets of the warp yarns 34 so as to form the top face ply 26. The first and second rib plies 30 and 32 are similarly formed by the remaining two shuttles, each of which is associated with and used exclusively to weave a different one of the rib plies 30 and 32.

The fabric 18 is woven, one pick at a time, by pulling a single fill yarn transversely between the opposite sets of the warp yarns using an appropriate one of the four different shuttles for the particular ply being woven. The harness and shuttle movements are programmed to carry out the weaving operation in the most expeditious manner. Such a program, for example, typically calls for the formation of several picks of the top face ply 26 followed by the formation of several picks of the first rib ply 30, then several picks of the second rib ply 32, and then several picks of the bottom face ply 28. The use of four separate shuttles avoids selvage interlock at the edges of the different plies and the necessity for cutting such selvage. Each of the rib plies 30 and 32 is interwoven with the opposite face plies 26 and 28 in the manner described in the previously referred to U.S. pat. No. 3,090,406 of Koppelman et al. The fabric as woven can be taken up using a takeup roll and cam arrangement of the type shown in that patent to allow weaving of the longer rib plies as opposed to the shorter face plies. However it is preferred that a takeup arrangement of the type shown in U.S. Pat. No. 3,168,115 of Rheaume, issued Feb. 2, 1965, be used. In such an arrangement the woven fabric is taken up by a roll which is periodically reversible to permit weaving of the rib plies. The warp yarns used to form the rib plies are fed into the weaving area from a pair of mating rolls and a tensioning device.

The yarns used to weave the face and rib plies of woven fabrics in accordance with the invention can comprise any appropriate material such as fiberglass. The fabric itself, once woven, can be impregnated with any appropriate resin such as epoxys or polyesters. In a typical method of manufacturing an article using the woven fabric of the present invention as described in said copending application Ser. No. 290,541, the fabric is first woven, after which the stiffening elements are inserted into the pockets formed between the adjacent pairs of ribs. Where the stiffening elements comprise unidirectional fibers, such elements can be inserted with the fibers thereof oriented in selected directions so as to optimize the strength of the resulting article and its resistance to forces applied in various directions. The triangular-shaped spaces between the adjacent ribs are then filled with mandrels to assist in holding the woven fabric erect during resin impregnation and curing. Where desired the opposite face plies can have one or more layers of material added thereto, which layers form an essentially integral part of the face plies when the woven fabric is impregnated and cured. Upon impregnation and curing the mandrels are removed from the triangularshaped spaces to provide the finished article.

As described in said copending application Ser. No. 290,541 the various stiffening elements which are inserted into the generally planar pockets in the fabric as woven can comprise a single layer or multiple layers of appropriate materials such as fiberglass. Moreover as described in a copending application Ser. No. 290,542, filed Sept. 20, 1972, now abandoned Donald M. Hatch and George D. Lee, MultiPly Woven Article Having Acoustical Elements Between Double Plies, which application is assigned to the same assignee as this application, the stiffening elements may comprise elements of appropriate material having therein a plurality of holes of appropriate size for acoustical purposes. When equipped with stiffening elements of this type the woven article becomes a highly useful acoustical panel or member which facilitates the introduction of acoustical wave energy into the interior thereof where such energy is readily dissipated to provide a sound deadening effect.

While the invention has been particularly shown and described with reference to a preferred embodiment thereof, it will be understood by those skilled in the art that various changes in form and details may be made without departing from the spirit and scope of the invention.

What is claimed is:

1. A woven panel construction comprising a pair of woven face members disposed in generally parallel, space-apart relation along the length of the panel and having generally like widths, and a plurality of woven rib members disposed between said face members, said rib members being spaced-apart in pairs along the length of the face members and alternately extending between the face members in a zig zag configuration, the rib members of each pair being interwoven with both of the face members and substantially parallel and spaced-apart between the face members to define a relatively thin, generally planar opening between each pair which extends the entire distance between the face members in the direction of the plane thereof, the pairs of rib members defining major openings of generally triangular-shaped cross-sections on opposite sides of each of the relatively thin, generally planar openings and between the face members.

2. The invention defined in claim 1, wherein the pairs of rib members are interwoven with each other at common picks yarns as well as with the face members at each of the face members.

3. A woven fabric comprising a pair of opposite broad faces disposed in parallel, spaced-apart relation along the length of the fabric, each of the faces being comprised of at least one ply of the woven fabric including transverse fill yarns spaced along the length of the fabric and longitudinal warp yarns extending along the length of the fabric and interwoven with the fill yarns, and a pair of rib plies defining a plurality of rib members, which are spaced-apart in pairs along the length of the faces and alternately extending between the faces in a zig zag configuration, each ply comprised of transverse fill yarns spaced along the length of the fabric and longitudinal warp yarns which extend substantially along the entire length of the fabric and which are interwoven with the fill yarns, each of the rib plies being alternately interwoven with the plies comprising the opposite faces at spaced intervals along the length of the fabric, the warp yarns of each of the rib plies and the warp yarns of each of the faces being interwoven with common fill yarns at each interweaving of one of the rib plies with one of the faces, the pair of rib plies being disposed in generally parallel, spaced-apart relation between the opposite faces to define a series of thin, planar openings, each of which extends in a given direction through the entire distance between the opposite faces to define the length thereof and has a thickness in a direction normal to said given direction which is many times smaller than the length thereof, the pair of rib plies and the thin, planar openings therebetween dividing the space between the opposite faces into a plurality of spaces considerably larger in crossectional area than the thin, planar openings, each of the spaces extending between the opposite faces and being bounded on opposite sides by different ones of the thin, planar openings.

4. The invention defined in claim 3, wherein one of the rib plies is alternately interwoven with the opposite faces at a first plurality of spaced-apart regions along the length of the fabric and the other one of the rib plies is alternately interwoven with the opposite faces at a second plurality of spaced-apart regions disposed adjacent to but offset from the first plurality of spaced-apart regions in a common direction along the length of the fabric.

* * * * *